United States Patent [19]

Brown

[11] Patent Number: 4,835,433

[45] Date of Patent: May 30, 1989

[54] APPARATUS FOR DIRECT CONVERSION OF RADIOACTIVE DECAY ENERGY TO ELECTRICAL ENERGY

[75] Inventor: Paul M. Brown, Boise, Id.

[73] Assignee: Nucell, Inc., Portland, Oreg.

[21] Appl. No.: 153,070

[22] Filed: Feb. 8, 1988

Related U.S. Application Data

[63] Continuation of Ser. No. 855,607, Apr. 23, 1986, abandoned.

[51] Int. Cl.[4] ..... G21H 1/00

[52] U.S. Cl. ..... 310/305; 136/202; 376/320

[58] Field of Search ..... 376/320, 321; 310/301, 310/304, 305; 136/202

[56] References Cited

U.S. PATENT DOCUMENTS

| | | | |
|---|---|---|---|
| 2,548,225 | 4/1951 | Linder | 310/304 |
| 2,712,097 | 6/1955 | Auwarter | 310/305 |
| 2,739,283 | 3/1956 | Roehrig | 310/301 |
| 3,290,522 | 12/1966 | Ginell | 310/305 |
| 3,409,820 | 11/1968 | Burke | 310/305 |
| 3,530,316 | 9/1970 | Burke | 310/301 |
| 3,562,613 | 2/1971 | Adler | 310/304 |
| 3,939,366 | 2/1976 | Ato et al. | 310/301 |
| 3,944,438 | 3/1976 | Hursen et al. | 136/202 |
| 4,489,269 | 12/1984 | Edling et al. | 376/320 |

*Primary Examiner*—Deborah L. Kyle
*Assistant Examiner*—Daniel Wasil
*Attorney, Agent, or Firm*—Leslie G. Murray

[57] ABSTRACT

A nuclear battery in which the energy imparted to radioactive decay products during the spontaneous disintegrations of radioactive material is utilized to sustain and amplify the oscillations in a high-Q LC tank circuit is provided. The circuit inductance comprises a coil wound on a core composed of radioactive nuclides connected in series with the primary winding of a power transformer. The core is fabricated from a mixture of three radioactive materials which decay primarily by alpha emission and provides a greater flux of radioactive decay products than the equivalent amount of a single radioactive nuclide.

10 Claims, 4 Drawing Sheets

APPARATUS FOR DIRECT CONVERSION OF RADIOACTIVE DECAY ENERGY TO ELECTRICAL ENERGY

CROSS REFERENCE TO RELATED APPLICATION

This is a continuation of application Ser. No. 06/855,607, filed Apr. 23, 1986, now abandoned.

BACKGROUND OF THE INVENTION

The present invention relates generally to apparatus for the direct conversion of the energy of radioactive decay products to electrical energy and, more particularly, to the utilization of an alpha source to sustain and amplify oscillations in an LC oscillator circuit.

A growing need exists today for small, compact, reliable, lightweight and self-contained rugged power supplies to provide electrical power in such applications as electric automobiles, homes, industrial, agricultural, recreational, remote monitoring systems and satellites. The majority of today's satellites are powered by solar cells and conventional chemical batteries and require only a small amount of power to operate. Radar, advanced communications satellites and, especially, high-technology weapons platforms will require much larger power sources than today's space power systems can deliver. For the very high power applications, nuclear reactors appear to be the answer. However, for the intermediate power range, 10 to 100 kilowatts (kw), the nuclear reactor presents formidable technical problems. Given today's efficiencies, it would require many acres of solar panels to provide 100 kw. Similarly, enough chemical fuel to provide 100 kw for any significant period of time would be too heavy and bulky for practical use.

Heretofore, there have been known several methods for conversion of radioactive energy released during the decay of natural radioactive elements into electrical energy. A grapefruit-sized radioisotope thermo-electric generator that utilized the heat produced from alpha particles emmitted as plutonium-238 decays was developed during the early 1950's. However, the power output was limited to a few hundred watts. Other methods converting the energy of radioactive decay directly into electrical energy are disclosed in U.S. Pat. Nos. 3,290,522; 3,409,820; and 3,939,366.

U.S. Pat. No. 3,290,522 entitled "Nuclear Emission Electrical Generator" issued to Robert Ginell on Dec. 6, 1966, discloses apparatus which provides electrical power by modulating the density of a cloud of charged particles confined within an enclosed space by a magnetic field. A radioactive material is positioned at the center of an enclosing hollow sphere having its inner surface coated with silver. The sphere is centrally positioned between the poles of a permanent magnet. The variation in the density of the cloud of charged particles causes a variation in the magnetic field created by the cloud. This variation in the magnetic field cuts an electrically conductive means to create an electrical potential and current therein. The density of the cloud of charged particles may be varied by applying a periodically varying electro-static or electro-magnetic field to the confined cloud of charged particles. The electrical energy is derived from the kinetic energy imparted to the charged particles (decay products) on the occurrence of a spontaneous disintegration event during the decay of the radioactive material. However, with this system, the conversion efficiency is very low and the amount of electrical power provided too small for most applications.

U.S. Pat. No. 3,409,820 entitled "Electric Power Appartus" issued to James O. Burke on Nov. 5, 1968, discloses an amplification of an electric current by the conduction of electric current through a radioactive material. While providing some current amplification, the system requires an external power source, such as a conventional battery, and thus, cannot provide sufficient power for most applications.

U.S. Pat. No. 3,939,366 entitled "Method of Converting Radioactive Energy to Electric Energy and Device for Performing the Same" issued to Yasuro Ato et al. on Feb. 17, 1976, discloses an apparatus in which radioactive energy is converted to electric energy by irradiating a semiconductor material with radioactive decay products to produce a number of electron-hole pairs in the material. A magnetic field is applied across the semiconductor material in a direction perpendicular to the direction of diffusion of the electron-hole pairs and to the direction of the applied magnetic field thus collecting the electrons and the holes at electrodes provided on the respective end faces of the semiconductor material to produce an electric potential across the semiconductor material. While the conversion efficiency of the system disclosed by Ato et al. is considerally higher than that disclosed by either Burke or Ginell, the power output of the system is not great enough for applications such as electric automobiles or satellites.

SUMMARY OF THE INVENTION

The primary object of the present invention is to provide an apparatus for the direct conversion of the energy of radioactive decay to electric energy.

Another object is to provide an electric power source which is small, compact, reliable, lightweight, self-contained and rugged and therefore adaptable for use in automobiles, homes, industrial, agricultural and recreational applications and satellites.

Still another object is to provide an electric power source capable of providing large amounts of power for long periods of time with little or no maintenance or refueling required.

In accordance with the principles of the present invention, a nuclear battery in which the energy imparted to radioactive decay products during the spontaneous disintegrations of radioactive material is utilized to sustain and amplify the oscillations in a high-Q LC tank circuit is provided. The inductance in the tank circuit comprises the primary of a power transformer and is wound about a core composed of a mixture of radioactive materials. A mixture of radioactive materials produces a greater flux of radioactive decay products than the use of a single radioactive material by itself produces thereby providing the necessary flux for large power output from a small core volume. Use of long-lived isotopes, such as radium, ensures that the nuclear battery will have a constant output for at least ten years.

BRIEF DESCRIPTION OF THE DRAWINGS

Other and further objects and advantages of the present invention will be apparent from the following detailed description with reference to the accompanying drawings in which.

DETAILED DESCRIPTION OF THE PREFERRED EMBODIMENT

Figure 1:
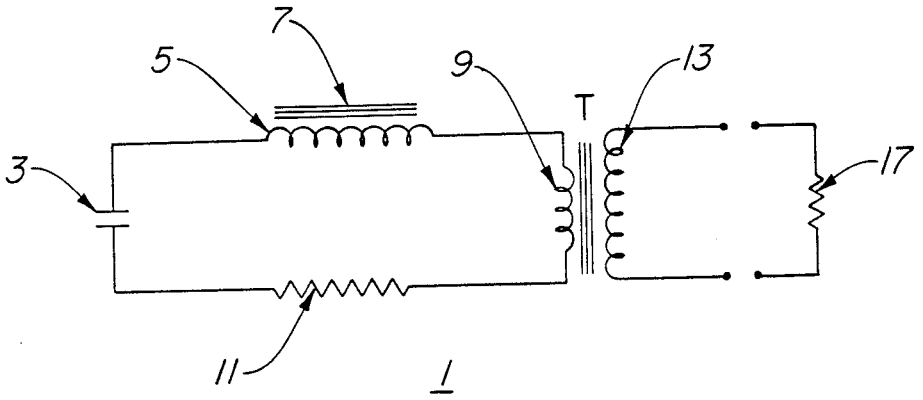
FIG. 1 is a schematic diagram of an LC equivalent resonant circuit according to the principles of the present invention.

Referring now to FIG. 1, an equivalent electrical circuit of a nuclear battery constructed according to the principles of the present invention is shown. An LCR circuit 1 is comprised of a capacitor 3, inductor 5, transformer T primary winding 9 and resistance 11 connected in series. It is assumed that the electrical conductors connecting the various circuit elements and forming the inductor 5 and primary winding 9 are perfect conductors; i.e., no DC resistance. Resistor 11 is a lump resistance equivalent to the total DC resistance of the actual circuit components and conductors. The inductor 5 is wound on a core 7 which is composed of a mixture of radioactive elements decaying primarily by alpha particle emission.

When current flows in an electrical circuit energy is dissipated or lost in the form of heat. Thus, when oscillations are induced in an LCR circuit, the oscillations will gradually damp out due to the loss of energy in the circuit unless energy is continuously added to the circuit to sustain the oscillations. In the LCR circuit shown in Figure 1, a portion of the energy imparted to the decay products, such as alpha particles, during the radioactive decay of the materials making up inductor core 7 is introduced into the circuit 1 when the decay products are absorbed by the conductor which forms inductor 5. Once oscillations have been induced in the LCR circuit 1, the energy absorbed by inductor 5 from the radioactive decay of the core 7 materials will sustain the oscillations as long as the amount of energy absorbed is equal to the amount of energy dissipated in the ohmic resistance of the circuit 1. If the absorbed is greater than the amount of energy lost through ohmic heating, the oscillations will be amplified. This excess energy can be delivered to a load 17 connected across the transformer T secondary winding 13.

The processes involved in the conversion of the energy released by the spontaneous disintegration of a radioactive material into electrical energy are numerous and complex. Materials that are naturally radioactive decay by the emission of either an alpha particle or a beta particle, and gamma rays may accompany either process. Radioactive materials that decay primarily by alpha particle emission are preferred as the inductor core 7 material. Alpha particles are emitted with very high speeds, on the order of $1.6\times10^7$ meters per second (m/s), and, consequently, have very high kinetic energy. Alpha particles emitted when radium, for example, decays are found to consist of two groups, those with a kinetic energy of $48.79\times10^5$ electron volts (ev) and those having an energy of $46.95\times10^5$ ev. This kinetic energy must be dissipated when the alpha particles are absorbed by the conductor forming inductor 5. During the absorption process, each alpha particle will collide with one or more atoms in the conductor knocking electrons from their orbits and imparting some kinetic energy to the electrons. This results in increased numbers of conduction electrons in the conductor thereby increasing its conductivity.

Since the alpha particle is a positively charged ion, while the alpha particle is moving it will have an associated magnetic field. When the alpha particle is stopped by the conductor, the magnetic field will collapse thereby inducing a pulse of current in the conductor producing a net increase in the current flowing in the circuit 1. Also, there will be additional electrons stripped from orbit due to ionization produced by the positively charged alpha particles.

Figure 2:
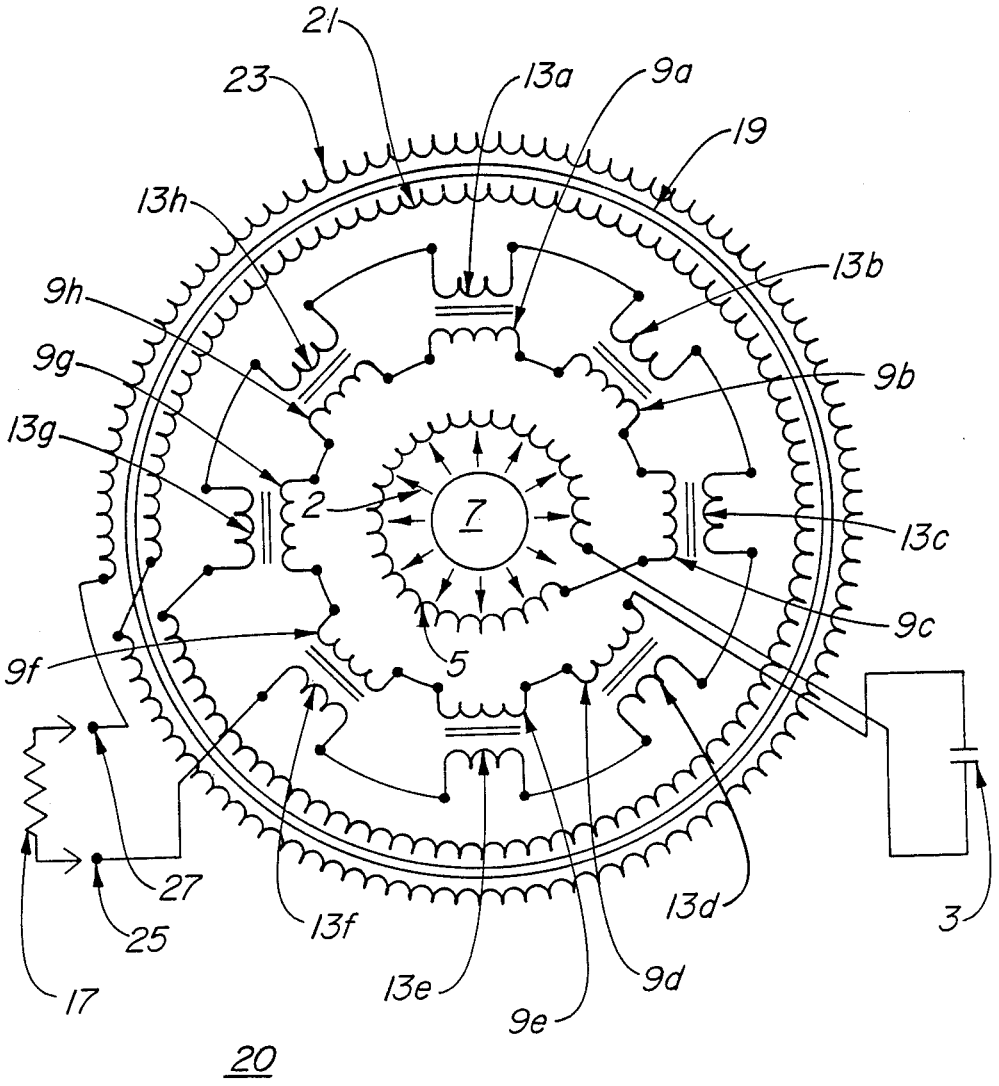
FIG. 2 is a wiring diagram of a nuclear battery constructed according to the principles of the present invention.

Referring now to FIG. 2, the nuclear battery 20 is constructed in a cylindrical configuration. Inductor 5 is constructed of copper wire wound in a single layer around the radioactive core 7. Decay products, such as alpha particles, are emitted radially outward from the core 7 as indicated by arrows 2 to be absorbed by the copper conductor forming inductor 5. Eight transformers 15 are arranged in a circular pattern to form a cylinder concentric with and surrounding inductor 5. The transformers 15 have primary windings 9*a*–9*h* connected in series which are then connected in series with inductor 5 and capacitor 3 to form an LCR circuit. The central core 7, inductor 5 and the eight transformers 15 are positioned within a cylindrical-shaped container 19. Copper wire is wound in a single layer on the outside wall and the inside wall of cylinder 19 to form windings 23 and 21 respectively. The transformers 15 secondary windings 13*a*–13*h* and windings 21 and 23 are connected in series to output terminals 25 and 27. The configuration of inductor 5 is designed to insure maximum irradiation of the copper conductor by the radioactive core source 7. The cylindrical configuration of the power transformer insures maximum transformer efficiency with minimum magnetic flux leakage.

Figure 3:
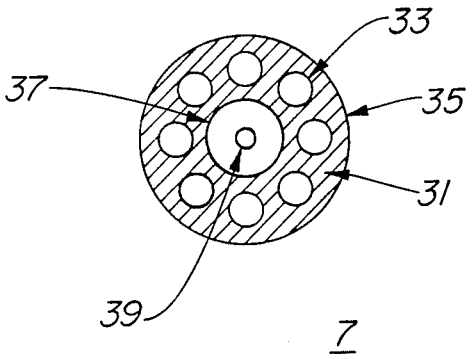
FIG. 3 is a plan view of the top of the radioactive core of the nuclear battery shown in FIG. 2.

Referring now to FIG. 3, the radioactive core 7 comprises a radium needle 39 surrounded by a cylinder of powdered thorium 31 having a plurality of uranium rods 33 positioned within the thorium 31. The powdered thorium 31 is contained by concentric cylinder walls 35 and 37. The use of a mixture of these radioactive materials for the core 7 produces a synergistic effect in that a greater flux of alpha particles is produced than by any one of the materials above due to additional induced disintegration events occuring.

Figure 4:
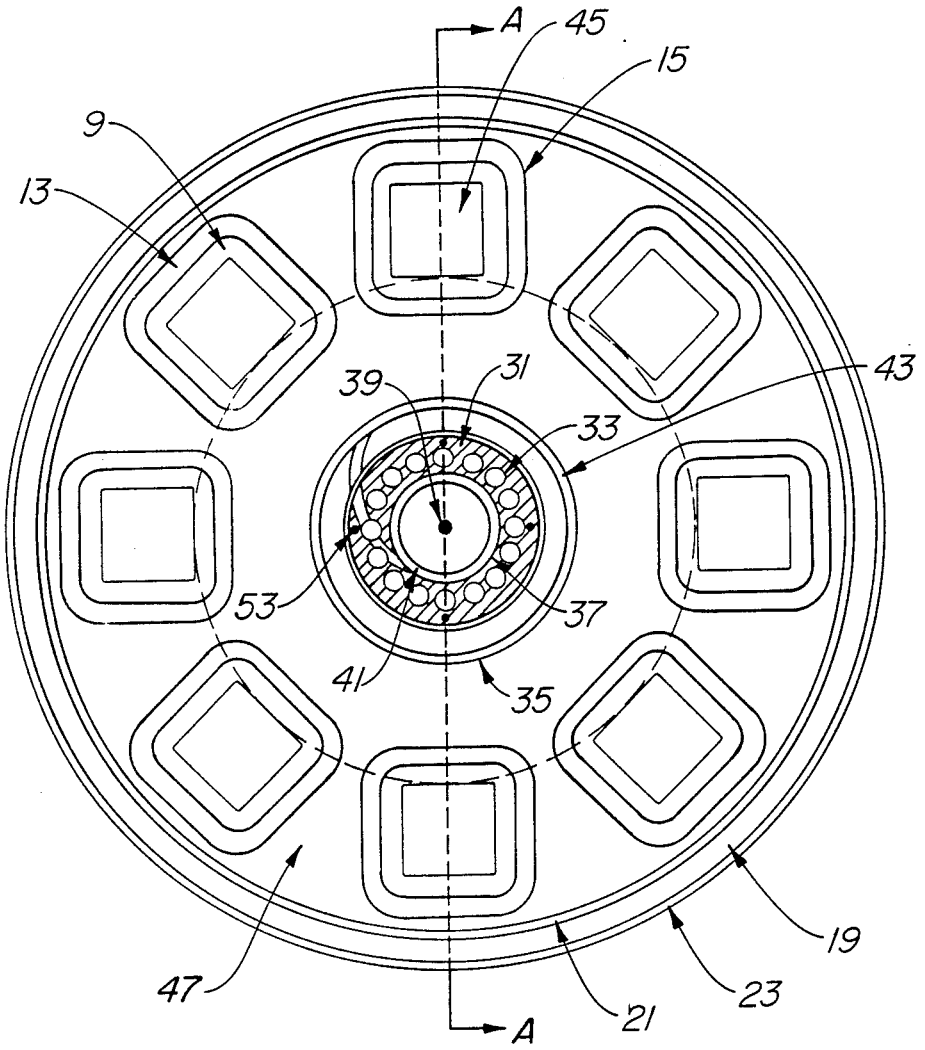
FIG. 4 is a plan view of the top of the nuclear battery shown in FIG. 2.
Figure 5:
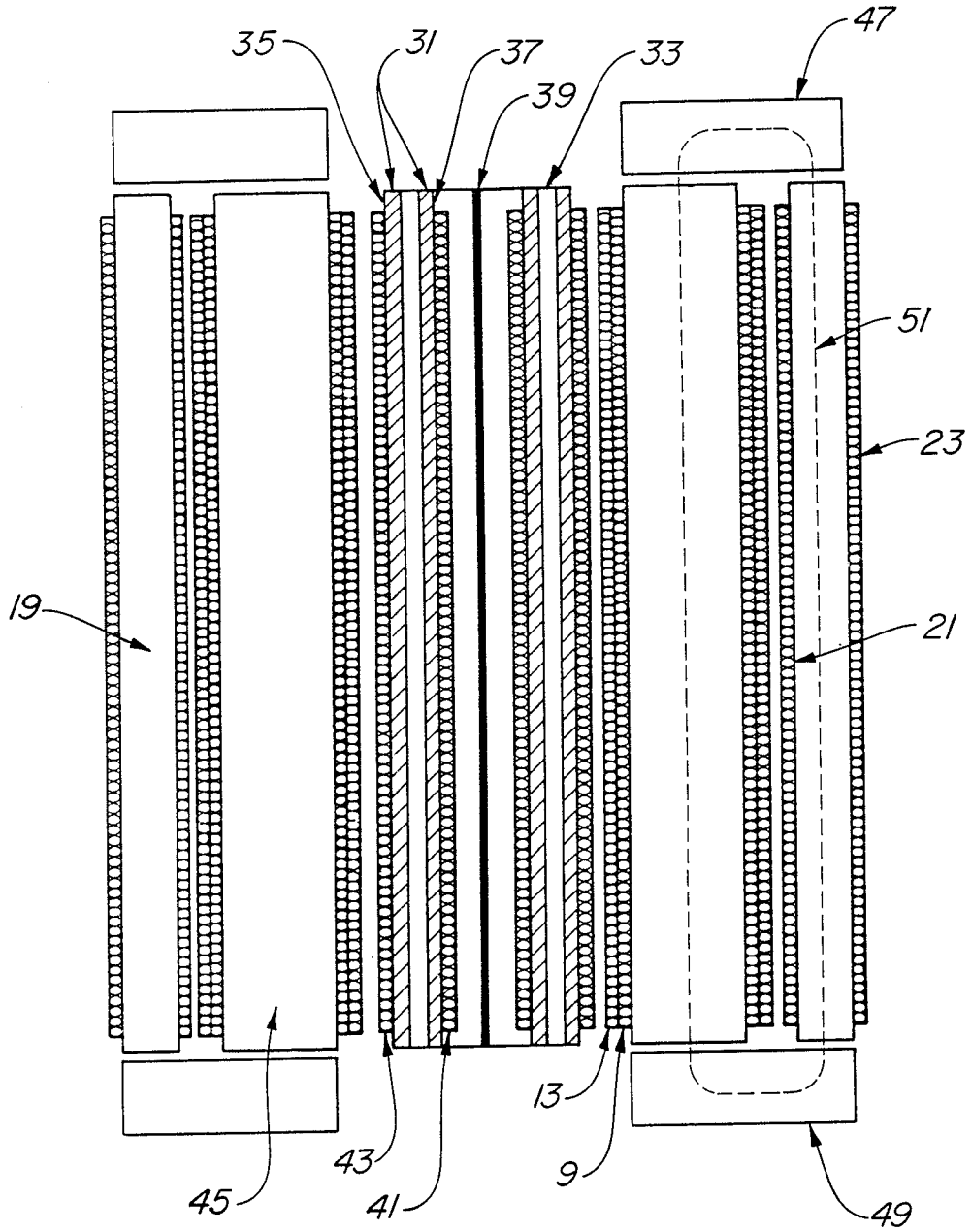
FIG. 5 is a side view taken along the line A—A of the nuclear battery shown in FIG. 3.

Referring now to FIGS. 4 and 5, top and side views of a nuclear battery constructed in accordance with the principles of the present invention is shown. The inductor core 7 consists of radium needle 39 positioned longitudinally in the center of a cylinder of powdered thorium 31. The powdered thorium 31 is contained by concentric cylinder walls 35 and 37 (a material such as light cardboard may be utilized for this purpose). Inductor 5 is formed from two layers of American Wire Gage (AWG) #8 copper wire, one layer 41 wound on the inward facing wall 37 surrounding the radium needle 39 and the other layer 43 wound on the outside of wall 35 thereby surrounding the powdered thorium 31 and uranium rods 33. The inductor core 7 is $1\frac{1}{4}$ inches in diameter and 6 inches long, with an overall diameter of $1\frac{5}{8}$ inches for inductor 5. The eight transformers 15 each have a core 45 of laminated silicon steel 3/4 inches square by 6 inches in length. The primary windings 9*a*–9*h* each consist of four layers of AWG #18 copper wire and the secondary windings 13*a*–13*h* each consist of two layers of AWG #12 copper wire. The transformers 15 have an overall outside diameter of $1\frac{1}{4}$ inches. The outer cylinder 19 is laminated silicon steel and an inner winding 21 of AWG #12 copper wire and an outer winding 23 of AWG #12 copper wire. End plates 47 and 49 consisting of $\frac{1}{2}$ inch thick annular rings of laminated silicon steel having an inner diameter of $2\frac{3}{4}$ inches and outer diameter of $4\frac{3}{4}$ inches are utilized to provide a low reluctance path to complete the magnetic circuit as shown by dashed line 51.

When assembled, the nuclear battery is immersed in an oil-filled can (not shown) equipped with heat sinks (not shown) to provide the necessary cooling for the power transformer. The capacitor 3 used in the LCR circuit is a high Q energy discharge resonant capacitor of the oil filled type.

Using a one millicurie radium needle 39, 200 grams of uranium 33 and 100 grams of powdered thorium 31 in the configuration shown in FIGS. 2 and 3, at 86 kiloHz, a continuous output of 23 amperes at 400 volts into a resistance load has been achieved. A configuration utilizing additional radium needles 53, as shown in FIG. 4, may be used to achieve higher power outputs.

While I have shown and described the preferred embodiment of my invention, it will be apparent to those skilled in the art that this invention is not limited to the specific structure described herein and that numerous changes and variations may be made therein without departing from the spirit of the invention or exceeding the scope of the appended claims.

I claim:

1. Apparatus for converting radioactive energy to electrical energy, said apparatus comprising:

an electrical conductor wound on a core to form an inductor having a first inductance, said core being of radioactive material;

a capacitor having a predetermined capacitance C;

a transformer having a primary winding, a secondary winding and a transformer core, said primary winding and said secondary winding wound on said transformer core, said primary winding having a second inductance, said secondary winding for coupling electrical energy to a workload; and electrical conductor means for connecting said inductor, said capacitor and said primary winding in series fashion to form a series LCR circuit wherein electrical oscillations are induced, said electrical oscillations being sustained and amplified by the energy transferred to said electrical conductor by the radioactive decay of said radioactive material, wherein L is the sum of said first inductance and said second inductance and R is a predetermined resistance.

2. Apparatus as in claim 1 wherein said core is comprised of at least two different radioactive materials.

3. Apparatus as in claim 2 wherein said radioactive materials decay primarily by alpha particle emission.

4. Apparatus as in claim 3 wherein said core is comprised of three radioactive materials.

5. Apparatus as in claim 4 wherein said three radioactive materials comprise radium, uranium and thorium.

6. Apparatus for converting the energy of radioactive decay products to electrical energy, said apparatus comprising:

an electrical conductor wound on a core to form an inductor having a first inductance, said core being fabricated of radioactive material;

a capacitor having a predetermined capacitance C;

a plurality of transformers disposed in a generally circular configuration to form a cylinder, said core being disposed within said cylinder, the longitudinal axis of said core being coincident with the longitudinal axis of said cylinder, each of said plurality of transformers having a primary winding and a secondary winding, each of said plurality of primary windings connected in series fashion with the remaining primary windings, each of said plurality of secondary windings connected in series fashion with the remaining secondary windings, said series-connected secondary windings for coupling electrical energy to a workload; and electrical conductor means for connecting said inductor, said capacitor, said series-connected primary windings and a predetermined resistance R in a series fashion to form a series LCR circuit wherein electrical oscillations are induced, said electrical oscillations being sustained and amplified by the energy transferred to said electrical conductor by the radioactive decay of said radioactive material.

7. Apparatus as in claim 6 wherein said core is comprised of at least two different radioactive materials.

8. Apparatus as in claim 7 wherein said series LCR circuit comprises an inductance L equivalent to the sum of the inductances of said inductor and said series-connected primary windings, capacitance C and a resistance R equal to the total distributed DC resistance of said LCR circuit.

9. Apparatus as in claim 8 further including an outer cylinder enclosing said cylinder and having its longitudinal axis coincident with the longitudinal axis of said core, an inner winding disposed adjacent the inner surface of said outer cylinder, an outer winding wound on the outer surface of said outer cylinder, said inner and outer windings connected in series fashion with said series-connected secondary windings for coupling electrical energy to a workload.

10. Apparatus as in claim 9 wherein said core is comprised of a mixture of radium, uranium, and thorium.

* * * * *